United States Patent [19]

Scotti et al.

[11] 4,429,814

[45] Feb. 7, 1984

[54] AEROSOL CONTAINER FOR DISPENSING THERMOSETTING POLYURETHANE FOAM

[76] Inventors: Frank Scotti, 450 Indian Rd., Wayne, N.J. 07470; Edward H. Page, 1021 Hillcrest Rd., Ridgewood, N.J. 07450

[21] Appl. No.: 392,178

[22] Filed: Jun. 25, 1982

[51] Int. Cl.[3] ..... B65D 83/14

[52] U.S. Cl. ..... 222/402.13; 222/402.24

[58] Field of Search ..... 239/337; 222/145, 148, 222/400.7, 402.1, 402.12, 402.13, 402.24, 406, 464, 567, 570, 402.21, 402.23

[56] References Cited

U.S. PATENT DOCUMENTS

| | | | |
|---|---|---|---|
| 2,587,040 | 2/1952 | Green | 299/150 |
| 2,646,192 | 7/1953 | Gronemeyer | 222/394 |
| 2,913,749 | 11/1959 | Ayres | 222/402.24 X |
| 3,033,425 | 5/1962 | Gawthrop | 222/402.24 X |
| 3,075,709 | 3/1963 | Green | 239/579 |
| 3,393,842 | 7/1968 | Bruce et al. | 222/402.1 X |

FOREIGN PATENT DOCUMENTS 1296098 5/1962 France .

*Primary Examiner*—Joseph J. Rolla
*Assistant Examiner*—Michael S. Huppert

[57] ABSTRACT

An aerosol container for dispensing thermo-setting polyurethane foam having an upstanding valve shell penetrating the top end of the container, a valve plunger disposed in the valve shell spring biased against an aperture in the top wall of the valve shell, a dip tube depending from the lower end of the valve shell toward the bottom of the container, and a resilient cap member detachably mounted to the top of the container wherein the cap member includes an upstanding dispensing nozzle having a downwardly depending conduit which depresses the valve plunger when the cap is depressed.

The nozzle, valve shell, valve plunger and dip tube are fabricated from a low moisture content plastic such as polypropylene, polyethelene, or oxymethylene polyethers.

14 Claims, 2 Drawing Figures

AEROSOL CONTAINER FOR DISPENSING THERMOSETTING POLYURETHANE FOAM

FIELD OF THE INVENTION

This invention relates to aerosol dispensers for thermosetting polyurethane foam.

BACKGROUND OF THE INVENTION

Thermosetting foams such as polyurethane foams are known to be effective caulking and sealant materials. Moreover, thermosetting polymeric foams have been packaged in aerosol containers. Aerosol containers provide a particularly facile means for dispensing a thermosetting polymer which upon release from the container valve machanism cures in open moist air. However, commercially available thermosetting resins which are packaged in aerosol containers have a tendency to clog due to the premature setting of the polymeric component in the interval valve passages of the container. This premature setting and clogging of the dispensing mechanism is believed to be due to the interaction of air and the thermosetting polymer in quite narrow valve passageways associated with the dispensing valve. Thus, the user may be faced with the difficult and complicated task of cleaning clogged valve passageways, or in the alternative, disposing of a partially filled container.

Polyurethane foams have many household uses such as sealing joints in woodwork, masonry and ceramics. The ease with which polyurethanes may be applied to a surface from an aerosol dispenser renders such products particularly well suited for do-it-yourself household use. Homeowners have a great interest today in sealing joints around windows, doors, wall masonry and the like to achieve energy conservation. Thus, it is important that effective caulkers or sealants be provided which can be conveniently applied without the recurrent problems of valve clogging which have been noted with known aerosol dispensed thermosetting resins.

OBJECT OF THE INVENTION

It is, therefore, an object of the present invention to provide an aerosol container having an improved dispensing assembly for use with thermosetting foams such as polyurethanes.

It is a further object of the present invention to provide an aerosol container having a dispensing assembly fabricated from a material which minimizes the setting of thermosetting polyurethane foam within the passages and valving of the dispensing assembly which have been exposed to air.

It is yet another object of the present invention to provide an aerosol container for dispensing thermosetting polyurethane foam having a dispensing assembly that is arranged and constructed for simplified cleaning of the passages of the container dispensing assembly.

It is still a further object of the present invention to provide a method for manufacturing such aerosol containers for dispensing thermosetting polyurethane foam.

These and other objects will be apparent from the following description and claims in conjunction with the drawings.

SUMMARY OF THE INVENTION

The present invention may be generally characterized as an aerosol container with an open top end, a closed bottom end and a cap member closing said top end, having the improvement of an assembly for dispensing thermosetting polyurethane foam comprising:

an upstanding valve shell mounted on and penetrating said cap member said valve shell having a top wall provided with an aperture and a lower end having and opening;

a spring biased valve plunger member disposed in said valve shell substantially coaxially aligned with said aperture and normally biased upwardly in sealing engagement with said top wall for preventing fluid flow through said aperture;

a cover member fabricated from flexible resilient material detachably mounted to said top end of said container;

a dispensing member mounted on and penetrating said cover member including a downwardly depending first conduit member substantially coaxially aligned with said aperture wherein said second conduit member normally terminates above said valve shell top wall;

a second conduit member depending from said valve shell lower end and terminating near said bottom end of said container for providing a fluid passage from said bottom end, through said opening and into said valve shell;

wherein providing a downward force on said resilient cover member causes said first conduit member to penetrate said aperture and engage and urge downward said valve plunger member and releasing said downward force results in said resilient cover member urging said first conduit member upward to said normal position wherein said first conduit terminates above said valve shell top wall permitting said spring biased valve plunger member to return to said normally biased sealing engagement with said valve shell top wall;

wherein said dispensing member including said first conduit member, said valve shell, said second conduit member, and said valve plunger member are fabricated from a plastic material having a moisture content of less than about 0.6 percent based on the weight of said plastic at 100% humidity at 25° C. at standard atmospheric pressure; and wherein said container has disposed therein a thermosetting resin and a propellant.

A second aspect of the present invention may be generally characterized as a method for the manufacture of an aerosol container for dispensing thermosetting polyurethane foam wherein said container has an open top end, a closed bottom end, a cap member closing said top end with said cap member having a first aperture, said method including the steps of:

(A) introducing into said container through said first aperture an organic polyol and an organic isocyanate wherein said polyol has a molecular weight from about 300 to 1000 and said isocyanate is about 2 to 5 equivalents per equivalent of said polyol;

(B) disposing in said first aperture a valve assembly comprising an upstanding valve shell having a top wall provided with a second aperture and a lower end having an opening, a spring biased valve plunger member positioned within said valve shell substantially coaxially aligned with said second aperture normally biased upward in sealing engagement with said top wall, and a first conduit member depending from said valve shell lower end and extending to terminate near said bottom end of said container, wherein a gas pervious passage remains between the periphery of said valve shell and said cap member;

(C) introducing into said container through said gas pervious passage a propellant selected from the group consisting of fluorated hydrocarbons and hydrocarbons thereby causing a substantially homogeneous mixing of said polyol and said isocyanate resulting in the formation of a polyurethane prepolymer reaction product;

(D) gas tightly joining said valve shell to said cap member;

(E) detachably mounting on said container top end a cover member fabricated from a flexible resilient material wherein said cover member has a dispensing member mounted thereon and penetrating therethrough, said dispensing member including a downwardly depending second conduit member substantially coaxilly aligned with said second aperture wherein said second conduit member normally terminates above said valve shell top wall so that providing a downward force on said resilient cover member causes said second conduit member to penetrate said second aperture and engage and urge downward said valve plunger member and releasing said downward force results in said resilient cover member urging said second conduit member upward to said normal position so that said second conduit member terminates above said valve shell top wall permitting said spring biased valve plunber member to return to said normally biased sealing engagement with said valve shell top wall; and wherein said dispensing member, said valve shell, said first conduit member and said valve plunger member are fabricated from a plastic material having a moisture content of less than about 0.6 percent based weight of the plastic at 100% humidity at 25° C. at standard atmospheric pressure.

BRIEF DESCRIPTION OF THE DRAWINGS

In the drawing forming part hereof.

DESCRIPTION OF THE PREFERRED EMBODIMENT

In order to afford a complete understanding of the present invention and an appreciation of its advantages, a description of the preferred embodiments is presented below.

Figure 1:
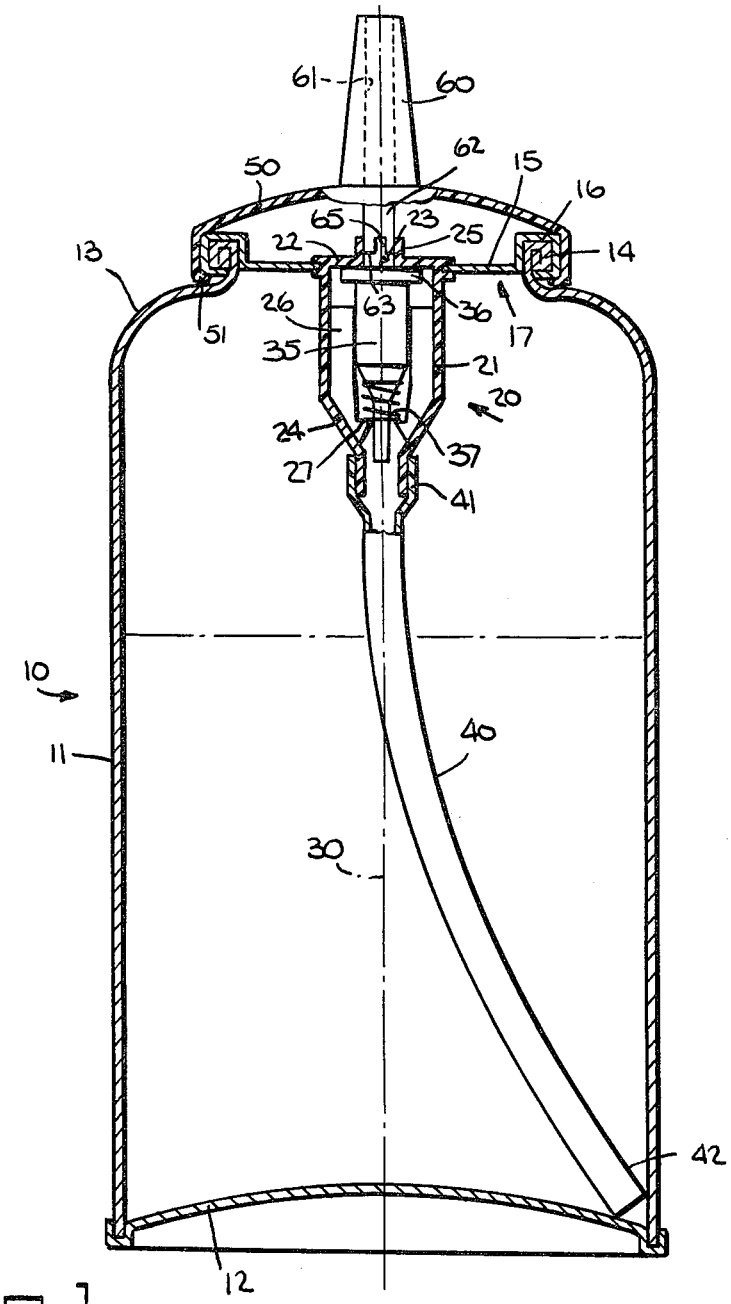
FIG. 1 is a schematic elevation view partially in cross-section of an aerosol container having an improved dispensing assembly for dispensing thermo-setting polyurethane foam in accordance with the present invention.

In FIG. 1 there is illustrated in an upright position a conventional aerosol container 10 having a side wall 11 suitably cylindrical in shape, a bottom 12, and a dome-shaped top member 13. The bottom 12 and dome-shaped top member 13 may be joined to the side walls by any convenient method used in the aerosol can art. The dome-shaped member 13 provides an open mouth at the top end 17 of the container. The dome-shaped member 13 has a rim 14. A dished-shaped cap member 15 having a rolled edge 16, which extends over rim 14, closes the open mouth of the top end 17 of container 10. The cap member 15 is fixedly joined to the dome-shaped member 13, for example, by crimping rolled edge 16 onto rim 14. If desired, gasket material (not shown) may be disposed between the rim 14 and rolled edge 16. The side wall 11, the bottom 12, the dome-shaped member 13 and cap member 15 may be suitably fabricated, for example, from sheet metal.

Cap member 15 has an aperture therein for receiving a valve shell 20. Most suitably, container 10 has a generally cylindrical shape and the aperture in cap member 15 for receiving valve shell 20 is generally circular in shape having a center substantially coincident with the central axis 30 of container 10.

Valve shell 20 comprises side wall 21 having a generally cylindrical shape and a planar top wall 22. Side wall 21 of valve shell 20 is joined to cap member 15, for example, by crimping. A generally cylindrically shaped guide wall 25 extends upwardly paralled to the central axis 30 of container 10 above the top wall 22 of valve shell 20. The central axis of the generally cylindrical shaped valve shell 20 and generally cylindrically shaped guide wall 25 would suitably be substantially coincident with the central axis 30 of container 10.

Top wall 22 of valve shell 20, which is suitably oriented substantially perpendicular to central axis 30 of container 10, is provided with an aperture 23 therein. Aperture 23 is suitably generally circular in shape having a center substantially coincident with central axis 30 of container 10.

The bottom portion 24 of valve shell 20 comprises a side wall portion of decreasing diameter. Thus, bottom portion 24 has the general shape of a truncated cone.

Disposed in valve shell 20 is a valve plunger member 35 which is positioned in valve shell 21 by a plurality of guide members 26. It will be appreciated that guide members 26 permit movement of valve plunger member 35 parallel to central axis 30 while maintaining the alignment of valve plunger member 35 with respect to central axis 30.

The top end of valve plunger member 35 advantageously has bonded thereto a gasket member 36 having an area sufficient to seal aperture 23 of top wall 22. Gasket member 36 is suitably fabricated from neoprene rubber. Valve plunger member 35 is spring biasedly mounted in valve shell 20 and coaxially aligned with aperture 23 such that it is normally biased upwardly in sealing engagement with top wall 22. As illustrated, the spring biasing is provided by helical coil spring 37 having a top portion surrounding and abutting the lower portion of valve plunger member 35 and a lower portion abutting shoulders 27 of the plurality of guide members 26.

Joined to the bottom portion 24 of valve shell 20 suitably, for example, by force fit, is the top 41 of a downwardly extending conduit member 40, suitably tubular in shape, sometimes referred to as dip tube. Conduit member 40 terminates at a second end 42 near the bottom 12 of container 10. As illustrated in FIG. 1, conduit member 40 preferably terminates near the side wall 11.

The container in accordance with the invention further comprises a cover member 50 fabricated from a flexible, resilient material such as polypropylene or polyethylene. Cover member 50 has the general shape of a concave shell having a U-shaped grove 51 at its outer peripheral circumference for snapping on and off the circumferential crimped joint formed by crimping rolled edge 16 of cap member 15 to rim 14. Thus cover member 15 is detachably mounted on container 10 in that it may be snapped on and off container 10.

Cover member 50 has mounted thereon and penetrating therethrough a dispensing member 60 having a bore 61 therethrough for providing a passage and a downwardly extending conduit member 62 which is in fluid flow communication with bore 61. Downwardly extending conduit member 62 terminates at a bottom end 63 above the elevation of top wall 22 of valve shell 20. Conduit member 62 is suitably tubular in shape, received by guide wall 25, and coaxially aligned with aperture 23 of top wall 22 of valve shell 20.

For reasons hereinafter discussed, dispensing member 60 is preferably a vertically upstanding spout or nozzle member. That is, the bore 61 of the nozzle member has a central axis that is substantially parallel to and substantially coincident with the central axis 30 of container 10.

Stated otherwise, the central axis of bore 61 will be substantially vertically oriented when aerosol container 10 is in a vertically upright position i.e., top end 13 up and bottom 12 down.

Bore 61 of dispensing member 60 is substantially coaxially aligned with conduit member 62 and hence with aperture 23 of top wall 22 of valve shell 20 and valve plunger member 35. The nozzle member 60 may be said to be vertically upstanding when container 10 is in a vertically upward position as illustrated in FIG. 1.

The nozzle portion 60 and the downwardly extending conduit 62 are suitably integrally formed from a plastic material which is preferably polypropylene, polyethylene or oxymethylene polyethers for reasons which will hereinafter be discussed.

Cover member 50 and dispensing member 60 are suitably integrally formed by molding fabrication techniques.

In operation, the aerosol container functions as follows. A moisture cured material such as a thermosetting polyurethane foam forming material is placed within the container along with a propellant or blowing agent. A downward force is provided on concave flexible, resilient cover member 50, for example, by the finger of a human hand. Dispensing member 60 and thus downwardly extending conduit member 62 are urged downward with conduit member 62 passing through aperture 23 and contacting valve plunger member 35. Therefore, valve plunger member 35 is urged downward compressing coil spring 37. A flow path is thereby provided from near the bottom 12 of container 10 through conduit member 40, into the chamber formed by valve shell 20, through a plurality of elongated slots 65 provided in the bottom of conduit member 62 into conduit 62 and bore 61 of nozzle 60 for dispensing the material. It will be appreciated that valve plunger member 35 does not seal the fluid passage from conduit member 40 into the chamber formed by valve shell 20 and that guide members 26 do not occupy a significant volume of the chamber formed by valve shell 20.

Upon releasing the downward pressure upon flexible, resilient cover member 50, the resilient cover member 50 urges dispensing member 60 and hence downwardly extending conduit 62 upwardly to its normal position wherein bottom 63 of conduit 62 is located above the elevation of top wall 22 of valve shell 20. Accordingly, compressed coil spring 37 urges valve plunger member 35 upward to its normally biased position in sealing engagement with top wall 22 thus sealing aperture 23.

In accordance with the present invention, the dispensing member 60 including downwardly extending conduit 62, the valve shell 20 including the walls 21, 24 and 25, the valve plunger member 35 and the dip tube conduit 40 are fabricated from a plastic having a moisture content of less than about 0.6 percent based on weight of the plastic at 100 percent humidity and 25° C. at standard atmospheric pressure.

Suitable plastics for the fabrication of the aforementioned parts are polypropylene, polyethylene and oxymethylene polyethers.

In accordance with the present invention, it has been discovered that thermosetting polyurethane foam is caused to set by the presence of moisture. Thus, the use of the low moisture content plastic material for fabrication of the aforementioned parts, in accordance with the present invention, greatly minimizes the setting and thus the attendant clogging of thermosetting polyurethane foams in aerosol can dispensing assemblies. The container of the present invention may be usefully employed for the dispensing of any thermosetting resin which is suitable for dispensing from aerosol containers. The art has frequently used nylon for the manufacture of upstanding valve components in aerosol containers which is not suitable for the present invention due to nylon's high moisture content.

A second aspect of the present invention is the use of the detachable cover member 50 and dispensing member 60 in combination with the arrangement of the valve assembly 20 and valve plunger member 35. Because of the use of the low moisture content material for fabrication of components, if any clogging occurs, it will occur nearest the ambient atmosphere. Thus, if any clogging problems arise, they most likely occur in the dispensing member 60. Since cover member 50 and along therewith dispensing member 60 are detachable from the container, the cover member and dispensing member may be conveniently rinsed, for example, in mineral spirits or nail polish remover (acetone) and the bore of the dispensing member easily cleaned by use of common household products such as tooth picks, pipe cleaners, or an opened up paper clip. Moreover, any clogging caused by setting of the thermosetting polyurethane foam in the region of aperture 23 is also readily cleaned upon removal of cover member 50. Clogging within the valve shell 20 and dip tube 40 is not, in general, a problem because they are further removed from the atmosphere and the use of the low moisture content material for fabrication of the aforementioned parts effectively insulates these regions from appreciable moisture. The valve plunger member 35 is fluid imperious meaning that the foam does not pass through passages in the valve plunger in order to egress from the container. Accordingly, there are no passages in the valve plunger member to be clogged.

The aerosol container in accordance with the present invention advantageously employs a dip tube having an end terminating near the bottom of the container in combination with an upstanding nozzle because for sealing vertical seams and horizontal seams which are not positioned below the operator of the container. It is natural to hold the container in an upright position. The location of the dip tube will permit a continuous dispensing of material from the container until the contents are exhausted when the container is held in the upright position—the most frequent convenient position of use.

If a seam is located below the operator of the container, the container is still operable in the inverted top end down—bottom end up orientation due to material retained within the dip tube. For a ¼ inch diameter dip tube in a conventional sized container, about 6 to 10 feet of dischargable material is retained in the dip tube. When the dip tube empties, the container may be re-inverted to its top end up—bottom end down orientation. The dip tube will refill and the container is again ready to function in a top end down—bottom end up orientation.

Figure 2:
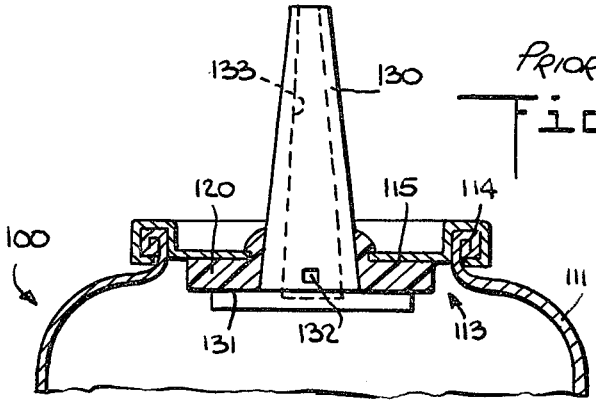
PRIOR ART Fig. 2.
FIG. 2 is a fragmentary schematic elevation view partially in cross-section illustrating the top end of a prior art aerosol container for dispensing thermo-setting polyurethane foam.

The advantages of the aerosol container in accordance with the present invention will become more readily appreciated by one skilled in the art by comparing it with a prior art aerosol can dispensing assembly in typical use for dispensing thermo-setting polyurethane foam as illustrated in FIG. 2.

In FIG. 2, the upper portion of a prior art aerosol container 100 for dispensing thermo-setting polyurethane foam is fragmentarily illustrated. The container 100 has a dish-shaped cap member 115 mounted on the rim 114 of container side wall 111 at the open mouthed top end 113 of the container. A resilient gasket member 120 is bonded to the bottom of cap member 115. What is generally known as a clayton type valve 130 penetrates resilient gasket member 120 and cap member 115 for providing egress from the interior of the container. Circumferential wall members 131 of valve 130 are closely adjacent resilient gasket member 120 when in normal nondispensing position. Valve member 130 is provided with a plurality of apertures 132 in its wall for providing fluid communication to internal bore 133. Apertures 132 are disposed within resilient gasket member 130 when the valve is in its normal non-dispensing position.

The prior art container of FIG. 2 functions as follows. A force is applied perpendicular to the central axis of valve 130, for example, by a finger of a human hand. If, for example, the perpendicular force is applied to the left in FIG. 2, the valve 130 will rotate in the resilient gasket material 120 such that the circumferential wall member 131 portion on the right hand side of the valve 130 will compress the resilient gasket material 120 and the circumferential wall member 131 portion on the left hand side of the valve 120 will separate from the resilient gasket material 120. This will provide a passage for thermo-setting polyurethane foam within the container 100 to flow through apertures 132 on the left hand side of the valve 130 and thus into bore 133 for dispensing from the valve. Release of the perpendicular force will cause the valve 130 to return to its normal position sealing the passages thus ending the dispensing of the thermo-setting polyurethane form.

It will be readily appreciated that if any of the thermo-setting polyurethane foam sets in the bore 133, apertures 132, or between circumferential wall member 131 and resilient gasket material 120, it will be very difficult and sometimes near impossible to clean the clogged passageways since the valve 130 is not removable and the clogged passageways may be remote from the user.

Moreover, the valve construction of the prior art aerosol container for the dispensing of polyurethane foam illustrated in FIG. 2 necessitates inverting the container to a bottom end up—top end down orientation to dispense foam which in many instances is inconvenient.

EXAMPLES

Thermo-setting polyurethane foam is produced in an aerosol container by the releasing of pressure on a foamable composition. This foamable composition typically comprises a polyurethane prepolymer which is the reaction product of an organic polyol having a weight average molecular weight of from about 300 to 1000, and an organic isocyanate which is present in an amount of about 2 to 5 equivalents per equivalent of the polyol.

The propellant may be a conventional fluorinated hydrocarbon, such as dichlorodifluoromethane or any conventional hydrocarbon propellant such as isobutane or dimethylether.

The internal pressure of the aerosol container is typically about 80 psig at 75° F. The major limitation on the strength of the container is the avoidance of container deformation during manufacture. In general, what is known in the art as a 2Q container (strength of the dome does not deform at 200 psig) should be satisfactory.

A preferred composition for providing the polyurethane prepolymer reaction product is about 25 to 30 weight percent oxypropylated glycerol; about 32 to 36 weight percent crude diphenylmethane diisocyanate; about 1 to 1.5 weight percent tris - 2 chloroethyl phosphate and about 0.03 to 0.05 weight percent NN-dimethylcyclohexylamine.

A preferred propellant or blowing agent is about 20 to 40 weight percent dichlorodifluoromethane based on the total weight of the contents.

An aerosol container of the type hereinbefore described for dispensing thermosetting polyurethane foam was manufactured as follows:

The hereinbefore described aerosol container was provided without the valve shell 20, dip tube 40, cover member 50 and dispensing member 60 installed. The container had an internal volume of about 500 cu. cm.

The following materials were introduced into the can via the aperture in cap member 15:

Oxypropylated glycerol—95 grams supplied by Olin Chemical of Stamford, Connecticut under the product name Poly G 30—168.

Crude diphenylmethane diisocyanate—122 grams supplied by Mobay Chem of Pittsburgh, Pennsylvania under the product name Mondur MRS—10.

Tris—2 chloroethyl phosphate—5 grams supplied by Stauffer Chemical Company under the product name Fyrol 6.

NN dimethylcyclohexylamine—0.05 grams supplied by Abbot Chemical Company.

Most suitably the crude diphenylmethane diisocyanate is first introduced into the container. Then, a preblended mixture of the oxypropylated glycerol, tris—2 chloroethyl phosphate and NN dimethylcyclohexylamine is added.

The hereinbefore described aerosol valve assembly 20 and the depending dip tube 40 are loosely inserted into the aperture of cap member 15.

The blowing agent or propellant is then introduced into the container by what is known in the art as the under cap fill method. A vacuum, e.g. about 15 psig is drawn on the container and the propellant is introduced around the circumferential edges of the valve shell 20 which has been loosely placed in the aperture of cap 15. The blowing agent is preferably dichlorodifluoromethane—130 grams supplied by E. I. DuPont under the product name Freon 12. The introduction of the propellant causes the homogeneous mixing of the material in the container and the reaction forming the prepolymer occurs. After introduction of the propellant, valve shell 20 is gas tightly joined to cap member 15, for example, by crimping.

During the filling operation, the container is suitably in a bath of about 130° F. After the filling of the container, the hereinbefore described cover member 50 with the integral upstanding dispensing member 60 are snapped on the container. The container 10 in accordance with the present invention is ready to operate as hereinbefore described.

Although preferred embodiments of the present invention have been described in detail, it is contemplated that modifications may be made within the spirit and scope of the invention.

What is claimed is:

1. In an aerosol container having an open top end, a closed bottom end and a cap member closing said top end, the improvement of an assembly for dispensing thermosetting resins comprising:

an upstanding valve shell mounted on and penetrating said cap member said valve shell having a top wall provided with an aperture and a lower end having an opening;

a spring biased fluid impervious valve plunger member disposed in said valve shell substantially coaxially aligned with said aperture and normally biased upwardly in sealing engagement with said top wall for preventing fluid flow through said aperture;

a cover member fabricated from flexible resilient material detachably mounted to said top end of said container;

a dispensing member mounted on and penetrating said cover member including a downwardly depending first conduit member substantially coaxially aligned with said aperture wherein said first conduit member normally terminates above said valve shell top wall;

a second conduit member depending from said valve shell lower end and terminating near said bottom end of said container for providing a fluid passage from said bottom end, through said opening and into said valve shell;

wherein providing a downward force on said resilient cover member causes said first conduit member to penetrate said aperture and engage and urge downward said valve plunger member and releasing said downward force results in said resilient cover member urging said first conduit member upward to said normal position wherein said first conduit member terminates above said valve shell top wall permitting said spring biased valve plunger member to return to said normally biased sealing engagement with said valve shell top wall;

wherein said dispensing member including said first conduit member, said valve shell, said second conduit member, and said valve plunger member are fabricated from a plastic material having a moisture content of less than about 0.6 percent based on the weight of said plastic at 100% humidity at 25° C. at standard atmosphere pressure; and wherein said container has disposed therein a thermosetting resin and a propellant.

2. A container as recited in claim 1 wherein said thermosetting resin is a polyurethane prepolymer reaction product and said propellant is selected from the group consisting of fluorated hydrocarbons and hydrocarbons.

3. A container as recited in claims 1 or 2 wherein the improvement further comprises said dispensing member including a nozzle member having a bore therethrough wherein said bore has a substantially vertically oriented central axis when said container is in an upright position and said bore is substantially coaxially aligned with said first conduit member, said aperture and said valve plunger member.

4. A container as recited in claims 1 or 2 wherein the improvement further comprises said plastic material being selected from the group consisting of polypropylene, polyethylene, and oxymethylene polyethers.

5. A container as recited in claim 2 wherein said polyurethane prepolymer is the reaction product of an organic polyol having a weight average molecular weight from about 300 to 1000 and an organic isocyanate being about 2 to 5 equivalents per equivalent of said polyol.

6. A container as recited in claim 2 wherein said propellant is dichlorodifluoromethane.

7. A container as recited in claim 2 wherein said polyurethane prepolymer is the reaction product of a composition comprising about 25 to 30 weight percent oxypropylated glycerol, about 32 to 36 weight percent crude diphenylmethane diisocyanate, about 1 to 1.5 weight percent tris—2 chloroethyl phosphate and about 0.03 to 0.05 weight percent NN dimethylcyclohexylamine.

8. A container as recited in claim 2 wherein said propellant is selected from the group consisting of isobutane and dimethylether.

9. In the manufacture of an aerosol container for dispensing thermosetting polyurethane foam wherein said container has an open top end, a closed bottom end, a cap member closing said top end with said cap member having a first aperture, the steps comprising:

(A) introducing into said container through said first aperture an organic polyol and an organic isocyanate wherein said polyol has a weight average molecular weight of from about 300 to 10000 and said isocyanate is about 2 to 5 equivalents per equivalent of said polyol;

(B) disposing in said first aperture a valve assembly comprising a upstanding valve shell having a top wall provided with a second aperture and a lower end having an opening, a spring biased fluid impervious valve plunger member positioned within said valve shell substantially coaxially aligned with said second aperture normally biased in sealing engagement with said top wall, and a first conduit member depending from said valve shell bottom end and extending to terminate near said bottom end of said container wherein a gas previous passage remains between the periphery of said valve shell and said cap member;

(C) introducing into said container through said gas pervious passage a propellant selected from the group consisting of fluorated hydrocarbons and hydrocarbons thereby causing a substantially homogeneous mixing of said polyol and said isocyanate resulting in the formation of a polyurethane prepolymer reaction product;

(D) gas tightly joining said valve shell to said cap member;

(E) detachably mounting on said container top end a cover member fabricated from a flexible resilient material wherein said cover member has a dispensing member mounted thereon and penetrating therethrough, said dispensing member including a downwardly depending second conduit member substantially coaxially aligned with said second aperture wherein said second conduit member normally terminates above said valve shell top wall so that providing a downward force on said resilient cover member causes said second conduit member to penetrate said second aperture and engage and urge downward said valve plunger member and releasing said downward force results in said resilient cover member urging said second conduit member upward to said normal position so that said second conduit member terminates above said valve shell top wall permitting said spring biased valve plunger member to return to said normally biased sealing engagement with said valve shell top wall; and wherein said dispensing member, said valve shell, said first conduit member and said valve plunger member are fabricated from a plastic material having a moisture content of less than about 0.6 percent based on weight of the plastic at 100% humidity at 25° C. at standard atmospheric pressure.

10. The manufacturing method as recited in claim 9 wherein step (A) comprises first introducing into said container crude diphenylmethane diisocyanate and then a preblended mixture of oxypropylated glycerol, tris-2 chloroethyl phosphate, and NN dimethylcyclohexylamine wherein the weight percent of the components based on total weight is crude diphenylmethane diisocyanate about 32% to 36%, oxypropylated glycerol about 25% to 30%, tris-2 chloroethyl phosphate about 1% to 1.5%, and NN dimethylcyclohexylamine about 0.03% to 0.05%.

11. The manufacturing method as recited in claim 9 wherein in step (E) said dispensing member includes a nozzle member having a bore therethrough wherein said bore has a substantially vertically oriented central axis when said container is in an upright position and said bore is substantially coaxially aligned with said second conduit member, said second aperture, and said valve plunger member.

12. The manufacturing method as recited in claim 9 wherein said propellant of step (C) is dichlorodifluoromethane.

13. A manufacturing method as recited in claim 9 wherein said plastic material is selected from the group consisting of polypropylene, polyethylene and oxymethylene polyethers.

14. A manufacturing method as recited in claim 9 wherein said propellant is selected from the group consisting of isobutane and dimethylether.

* * * * *

UNITED STATES PATENT AND TRADEMARK OFFICE

CERTIFICATE OF CORRECTION

PATENT NO. : 4,429,814

DATED : February 7, 1984

INVENTOR(S) : Frank Scotti and Edward H. Page

It is certified that error appears in the above-identified patent and that said Letters Patent is hereby corrected as shown below:

Column 1, line 21, "interval" should read --internal--.

Column 10, line 40, "a", first occurrence, should read --an--.

Signed and Sealed this

Fourth Day of September, 1990

*Attest:*

HARRY F. MANBECK, JR.

*Attesting Officer*

*Commissioner of Patents and Trademarks*